US009223262B2

(12) United States Patent
Takahashi

(10) Patent No.: US 9,223,262 B2
(45) Date of Patent: Dec. 29, 2015

(54) ELECTROSTATIC-TYPE PRINTING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kazutoshi Takahashi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/601,328

(22) Filed: Jan. 21, 2015

(65) Prior Publication Data

US 2015/0205234 A1 Jul. 23, 2015

(30) Foreign Application Priority Data

Jan. 23, 2014 (JP) ..... 2014-010481

(51) Int. Cl.
*G03G 15/20* (2006.01)

(52) U.S. Cl.
CPC ..... *G03G 15/2025* (2013.01)

(58) Field of Classification Search
CPC ..... G03G 15/2028; G03G 15/2075; G03G 15/2085
See application file for complete search history.

(56) References Cited

U.S. PATENT DOCUMENTS 5,500,726 A * 3/1996 Aoyama et al. ..... 399/339
2004/0223794 A1* 11/2004 Tomatsu ..... 399/323

FOREIGN PATENT DOCUMENTS

JP 2009-092683 4/2009

* cited by examiner

*Primary Examiner* — Clayton E Laballe
*Assistant Examiner* — Victor Verbitsky
(74) *Attorney, Agent, or Firm* — Amin, Turocy & Watson, LLP

(57) ABSTRACT

An image processing apparatus comprises a heat roller configured to have a roller surface for contacting a medium on which the unfixed toner image is transferred; a press roller configured opposite to the heat roller; a guide configured along a conveyance space from an inlet arranged at the downstream side in the conveyance direction of the medium, which is conveyed and nipped by the heat roller and the press roller, to an outlet of the medium; a lever configured to be provided with a swing shaft with respect to the guide, a peeling claw arranged at the inlet side for scraping the toner off the roller surface, and a lever end positioned at the outlet side; and a swing section configured to swing and energize the lever to make the lever end protrude into the conveyance space, wherein the lever that is swung and energized by the swing section repeats the following operations: separating the peeling claw in a contacted state with the roller surface from the roller surface, and restoring the peeling claw to the contacted state.

4 Claims, 8 Drawing Sheets

ELECTROSTATIC-TYPE PRINTING APPARATUS

CROSS-REFERENCE TO RELATED APPLICATION

This application is based upon and claims the benefit of priority from Japanese Patent Application No. 2014-010481, filed Jan. 23, 2014, the entire contents of which are incorporated herein by reference.

FIELD

Embodiments described herein relate generally to an image processing apparatus.

BACKGROUND

A fixing device conveys a paper with nipping the paper between a heat roller and a press roller, and peels off the paper, which is subjected to a fixing processing and is wound around the heat roller, from the heat roller by an arm-shaped peeling member with a peeling claw arranged at the downstream side in the conveyance direction (for example, see Japanese Unexamined Patent Application Publication No. 2012-98511). The peeling member is swung freely by a pivot bearing at the center part thereof, and the peeling claw is arranged on one end of the pivot bearing, the other end of the pivot bearing is energized by a spring and the like. In this way, the heat roller rotates in a state where the peeling claw is slidably in contact with the roller surface (outer peripheral surface of roller) of the heat roller. The paper surface on which the toner is carried is in contact with the heat roller to be heated and pressed, and thus the toner is melted and the toner permeates the paper. The toner has viscosity, and the toner that cannot be fixed on the paper adheres to the roller surface of the heat roller. When the toner on the roller surface is scraped by the peeling claw, the toner sticks to the front end of the peeling claw slidably in contact with the roller surface. Conventionally, there is known an image forming apparatus in which the rotation of a fixing roller is stopped temporarily according to the integration value of the printing ratio, and the toner adhered to the peeling claw is transmitted to the fixing roller (for example, see Japanese Unexamined Patent Application Publication No. 2009-92683). In an image forming apparatus capable of carrying out duplex printing, through the speed control to the heat roller and the paper discharge roller pair, the rubbing of paper by the peeling claw when the paper subjected to simplex printing is switched back and conveyed is not generated (for example, see Japanese Unexamined Patent Application Publication No. 2006-251178).

DETAILED DESCRIPTION

Figure 1:
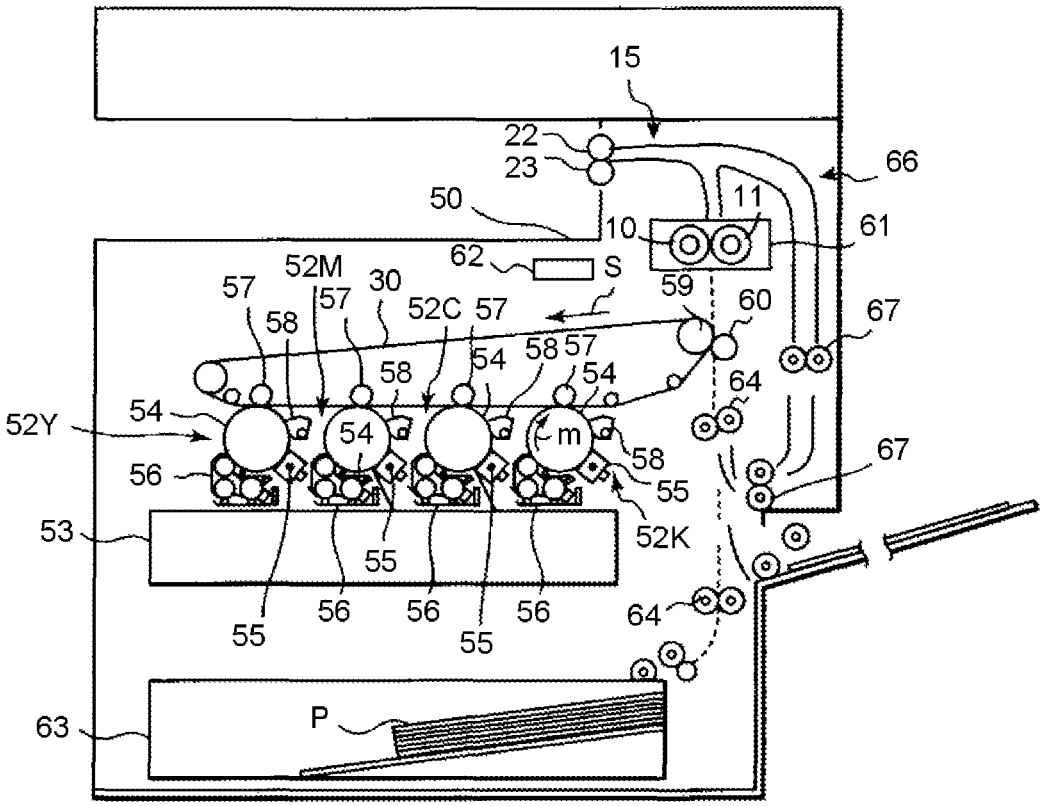
FIG. 1 is a constitution diagram of an image processing apparatus according to an embodiment.

In accordance with one embodiment, an image processing apparatus comprises a heat roller configured to have a roller surface for contacting a medium on which the unfixed toner image is transferred; a press roller configured opposite to the heat roller; a guide configured along a conveyance space from an inlet arranged at the downstream side in the conveyance direction of the medium, which is conveyed and nipped by the heat roller and the press roller, to an outlet of the medium; a lever configured to be provided with a swing shaft with respect to the guide, a peeling claw arranged at the inlet side for scraping the toner off the roller surface, and a lever end positioned at the outlet side; and a swing section configured to swing and energize the lever to make the lever end protrude into the conveyance space, wherein the lever that is swung and energized by the swing section repeats the following operations: separating the peeling claw in a contacted state with the roller surface from the roller surface, and restoring the peeling claw to the contacted state.

Hereinafter, the image processing apparatus according to the embodiment is described with reference to FIG. 1-FIG. 8. Further, the same components are applied with the same reference numerals in the drawings, and the repetitive description thereof is not provided.

One Embodiment

FIG. 1 is a constitution diagram of an image processing apparatus according to the embodiment. The image processing apparatus according to the present embodiment comprises four color image forming sections 52Y, 52M, 52C and 52K each of which has a photoconductive drum 54, an exposure device 53 configured to form an electrostatic latent image on each photoconductive drum 54, and an endless belt 30 configured to travel in a direction indicated by an arrow S. The yellow (Y) image forming section 52Y is provided with a charger 55 configured to charge the photoconductive drum 54 that rotates in a direction indicated by an arrow m, a developing device 56 configured to develop an electrostatic latent image to be formed by the exposure device 53 with the toner, a transfer device 57 configured to primarily transfer the developed toner image to the outer peripheral surface of the belt 30, and a cleaner 58 configured to clean the surface of the photoconductive drum 54 after the transfer processing. The constitutions of the magenta (M) image forming section 52M, the cyan (C) image forming section 52C and the black (K) image forming section 52K are identical to the constitution of the image forming section 52Y. The image processing apparatus further includes a pair of secondary transfer rollers 59 and 60 configured to transfer the four color unfixed toner image to a paper P (medium), a fixing device 61 configured to fix the toner image, a pair of paper discharge rollers 22 and 23 configured to discharge the fixed paper P to a paper discharge tray 50, and a controller 62. In addition, the image processing apparatus includes a paper feed section 63 on which the papers P are set, a plurality of roller pairs 64 configured to pick up the paper P from the paper feed section 63 and convey the paper P to a secondary transfer position, a guide 15 from the outlet side of the fixing device 61 to the pair of paper discharge rollers 22 and 23, a reversal guide 66 bifurcating from the guide 15 configured to turn the paper P upside down and feed it to the secondary transfer position, and a plurality of roller pairs 67 configured respectively in the reversal guide 66.

Figure 2:
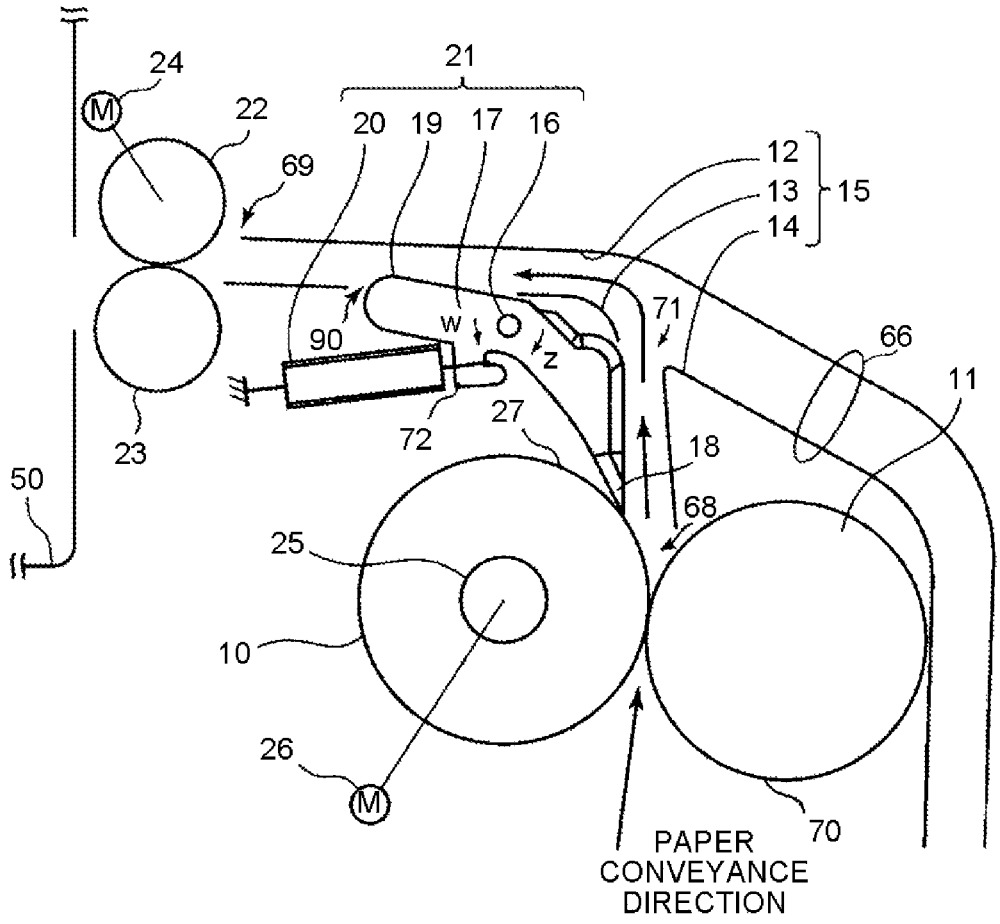
FIG. 2 is a diagram illustrating a conveyance path at the output side of a heat roller and a press roller of the image processing apparatus according to the embodiment.

FIG. 2 is a diagram illustrating a conveyance path including the fixing device 61. The reference numerals mentioned above represent the same components as defined in FIG. 1. The image processing apparatus according to the present embodiment includes a heat roller 10 having a roller surface 27 for contacting the paper P on which the unfixed toner image is transferred, a press roller 11 arranged opposite to the heat roller 10, and a guide 15 configured along a conveyance space from an inlet 68 arranged at the downstream side in the conveyance direction of the paper P, which is conveyed and nipped by the heat roller 10 and the press roller 11, to an outlet 69 of the paper P. The image processing apparatus includes a lever 17 provided with a swing shaft 16 with respect to the guide 15, a peeling claw 18 arranged at the inlet side 68 for scraping the toner off the roller surface 27, and a lever end 19 positioned at the outlet side 69; and a return mechanism 21 configured to swing and energize the lever 17 to make the lever end 19 protrude into the conveyance space by a spring 20 (swing section), wherein the lever 17 that is swung and energized by the return mechanism 21 repeats the following operations: separating the peeling claw 18 in a contacted state with the roller surface 27 from the roller surface 27, and restoring the peeling claw 18 to the contacted state. The heat roller 10, the press roller 11 and the peeling claw 18 constitute the fixing device 61.

The heat roller 10 heats the toner to fix the toner on the paper P. The heat roller 10 is formed by the metal material such as aluminum, iron and the like, and a coating is performed on the surface of the heat roller 10 with a coating material having good peeling property such that the toner is hard to adhere to the surface. The heat roller 10 generates heat through a heater 25. A halogen lamp is used as the heater 25. The heat roller 10 obtains a rotation force from a motor 26 or gears (not shown) for transmitting power.

The press roller 11 is a roller component for pressing the paper P to fix the toner. The press roller 11 contains a metal shaft body for ensuring the pressure surface, and a synthetic rubber wound around the shaft body. The press roller 11 having a pressing force presses a roller surface 70 thereof against the roller surface 27 of the heat roller 10, and in this way, the paper P is nipped at a nip between the roller surfaces 27 and 70. The press roller 11 is rotated together with the heat roller 10, or receives the rotation force from gears for the heat roller 10.

The guide 15 is a conveyance path guide for guiding the paper P to the paper discharge side. The guide 15 is provided with an upper guide wall 12, a first lower guide wall 13 and a second lower guide wall 14. During the duplex printing, the rear end of the paper P is switched back at a position near the pair of the paper discharge rollers 22 and 23, and the rear end of paper (which is changed to be the front end of paper) passes through the first lower guide wall 13. The guide 15 is formed continuously with the reversal guide 66 serving as a reversal conveyance path via a three-way bifurcating point 71. The upper guide wall 12 has a curved surface inclined to a lower right in FIG. 2 from the pair of the paper discharge rollers 22 and 23 via the bifurcating point 71, and the reversal guide 66 is formed by the upper guide wall 12 and the second lower guide wall 14. The first lower guide wall 13 forms a switchback conveyance zone together with the upper guide wall 12. The switchback conveyance zone is a reversal conveyance zone of the paper P from the pair of the paper discharge rollers 22 and 23 to the bifurcating point 71 or the inlet of the reversal guide 66. More than one opening 90 is properly formed in the first lower guide wall 13, the lever 17 can be swung and the rotation thereof isn't regulated, and the lever end 19 can be protruded through the openings 90.

Further, the paper discharge roller 22 within the pair of the paper discharge rollers 22 and 23 arranged at the outlet side 69 of the guide 15 is a driving roller driven by a motor 24, and the paper discharge roller 23 is a driven roller interlocked to rotate with the paper discharge roller 22. During the duplex printing, the direction of the rotation is reversed, and the pair of the paper discharge rollers 22 and 23 sends the paper P to the switchback conveyance zone, that is, the first lower guide wall 13.

The return mechanism 21 repeats the following operations: separating the peeling claw 18 from the roller surface 27 by interlocking with the pressing of the lever end 19 downward due to the contact of the paper P in a state of being applied with a tension by the pair of the paper discharge rollers 22 and 23 with the lever end 19, and restoring the peeling claw 18 in a separated state to the contacted state by interlocking with the restoration of the lever end 19 to the protruding position at the upper portion due to the passing of the rear end of the paper P through the lever end 19. The return mechanism 21 includes the lever 17 having the swing shaft 16, the peeling claw 18 and the lever end 19, and the spring 20. The swing shaft 16 swings or rotates in a clockwise direction z or an anticlockwise direction w.

The peeling claw 18 is a peeling member for peeling off the paper P wound around the heat roller 10. The front end of the peeling claw 18 has a sharp shape so as to enter between the paper P and the heat roller. The "sharp" refers to that a claw part is formed, and the crossing angle intersecting at the front end on the peeling claw surface is sharp. The size in the apparatus depth direction of the peeling claw 18 is thinner than the width of the image area of the heat roller 10. This size may be varied. The lever end 19 is a molded part formed continuously with the lever main body in the left-half part of the lever 17. The lever 17 is a holder for the peeling claw 18 and the lever end 19, and is a molded component made of metal or synthesized resin. A fulcrum for pressing the front end of the peeling claw 18 against the heat roller 10 (the fulcrum is the rotation center of the swing shaft 16) and a hook 72 for hooking the spring 20 are arranged in the lever 17. In the image processing apparatus according to the present embodiment, the lever 17 is positioned at the rear portion at the paper discharge side of the peeling claw 18 in such a manner that the lever 17 is protruded into the conveyance path of the paper P. The lever 17 is pivotally supported by a frame member and the like in the image processing apparatus, and when the paper P passes, the lever 17 rotates in the anticlockwise direction w and the front end of the peeling claw 18 is lifted (refer to FIG. 2). The peeling claw 18 is constituted by a heat-resistant material to prevent the deformation due to the heat of the heat roller 10, and a coating is performed on the surface of the peeling claw 18 to prevent the toner adhesion to the surface. The spring 20 is used to press the front end of the peeling claw 18 against the heat roller 10, and one end of which is locked to the hook 72 and the other end of which is fixed on the frame member and the like of the apparatus.

Next, the operations of the image processing apparatus having the above-described constitution according to the present embodiment are described. As shown in FIG. 1 and FIG. 2, the image processing apparatus transfers the unfixed four color toner image to the paper P. The controller 62 performs the timing control of the start and end of the driving for the motor 24 of the pair of the paper discharge rollers 22 and 23 and the motor 26 for fixing, and carries out the discharging conveyance, the fixing control of the fixing device 61 and the switchback conveyance.

Before the printing, the return mechanism 21 is in a state where the peeling claw 18 is abutted against the heat roller 10. In the image processing apparatus, one paper P is picked up from the paper feed section 63 and the heat roller 10 is started to rotate. The paper P is conveyed upward by the heat roller 10 and the press roller 11. The paper P is conveyed in a state of being sticking to the heat roller 10 due to the viscosity of toner, and the front end of the paper P directs to and arrives at the peeling claw 18 that is slidably in contact with the heat roller 10 in a counter direction to the rotation direction of the heat roller 10. The peeling claw 18 enters between the heat roller 10 and the paper P to peel off the paper P from the heat roller 10. The viscosity of toner is increased as the temperature rises, and the four color toner is remained on the roller surface 27 of the heat roller 10. The residual toner adheres to the peeling claw 18.

Figure 3:
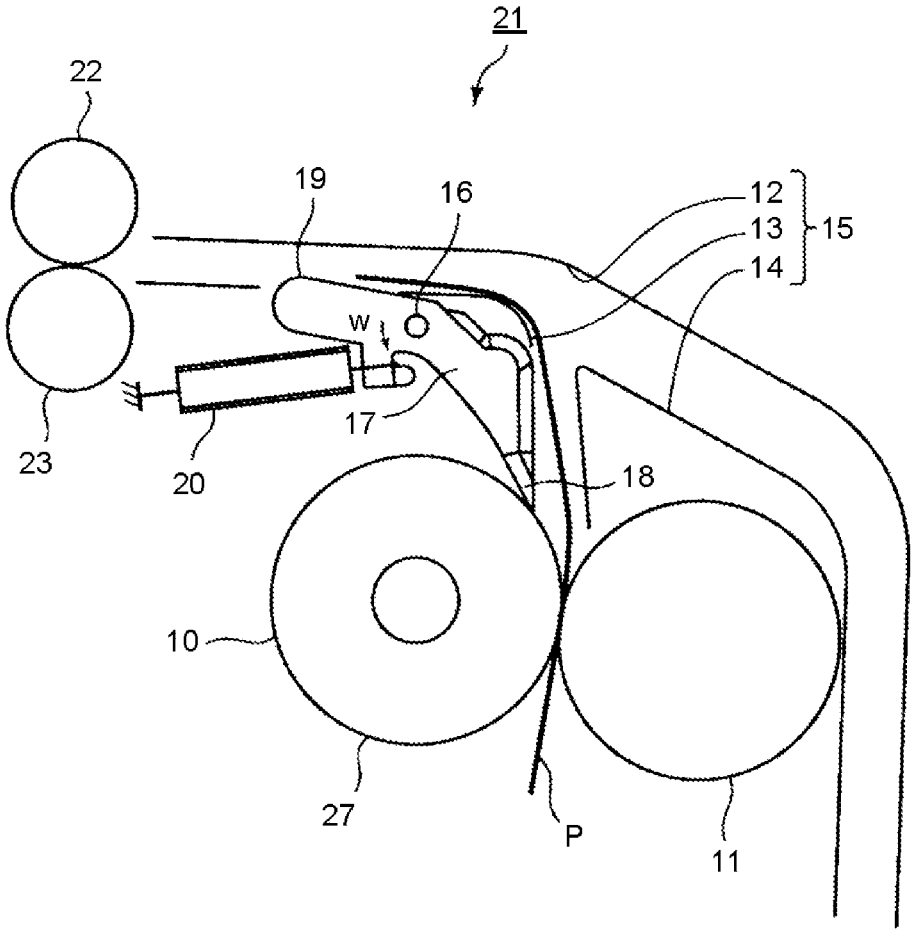
FIG. 3 is a diagram illustrating a first state of a return mechanism of the image processing apparatus according to the embodiment.

FIG. 3 is a diagram illustrating a first state of the return mechanism 21 of the image processing apparatus according to the present embodiment. The reference numerals mentioned above represent the same components as defined in FIG. 1-FIG. 2. After the paper P is peeled off, the paper P is conveyed to left in the guide 15 through the curved part to the left in the guide 15 and the guiding of the second lower guide wall 14. The controller 62 can predetermine the start timing of the rotation driving of the pair of the paper discharge rollers 22 and 23 according to various kinds of information including the size in the conveyance direction of the paper P, the rotation speed of the motor 26 of the fixing device 61 and the length of the conveyance path of the guide 15, and the controller 62 starts to rotate the pair of the paper discharge rollers 22 and 23 while the paper P is being conveyed in the guide 15.

Figure 4:
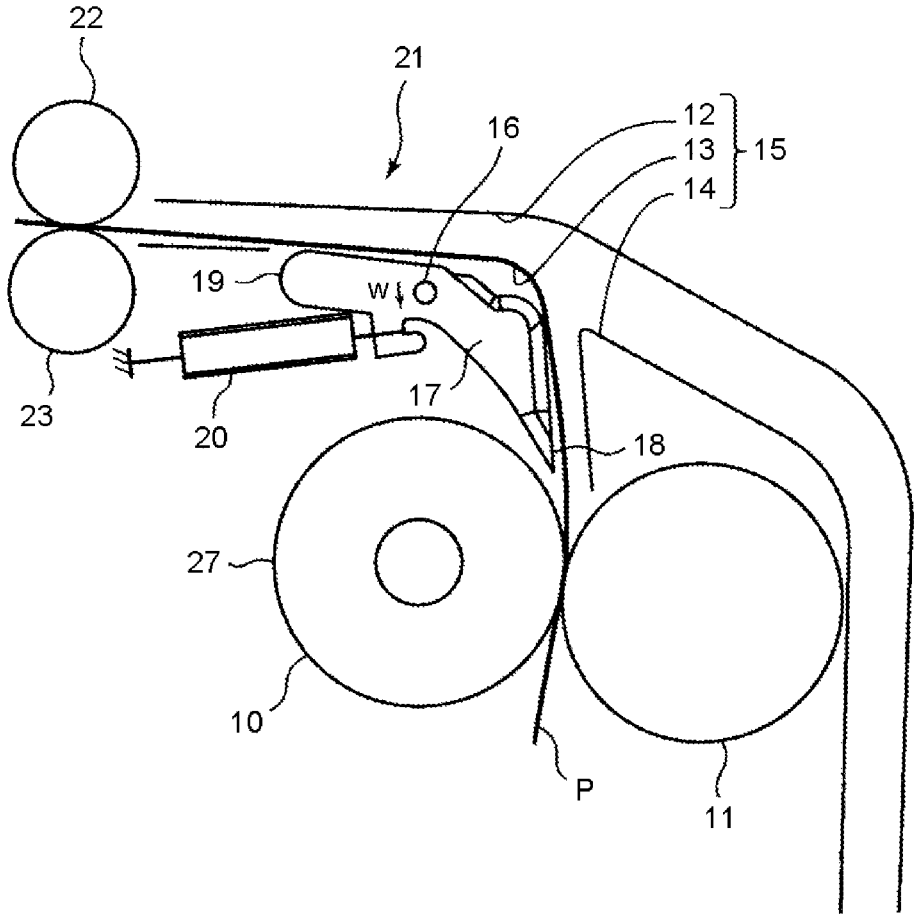
FIG. 4 is a diagram illustrating a second state of a return mechanism of the image processing apparatus according to the embodiment.

FIG. 4 is a diagram illustrating a second state of the return mechanism 21 of the image processing apparatus according to the present embodiment. The pair of the paper discharge rollers 22 and 23 rotates in the forward direction immediately before the front end of the paper P reaches the pair of the paper discharge rollers 22 and 23, and then the front end of the paper P is drawn into a space between the pair of the paper discharge rollers 22 and 23. Since the rotation speed of the pair of the paper discharge rollers 22 and 23 is controlled to be higher than the rotation speed of the heat roller 10 and the press roller 11 by the controller 62, a tension is applied to the paper P by the pair of the paper discharge rollers 22 and 23. As a result, the paper P is in a taut state and is against the energization force of the spring 20 to the lever 17, and thus the taut paper P presses the lever end 19 downward. The lever 17 swings in the anticlockwise direction w by interlocking with the pressing of the lever end 19, and the peeling claw 18 is lifted from the roller surface 27.

Sequentially, when the pair of the paper discharge rollers 22 and 23 discharges the paper P, the rear end of the paper P passes through the lever end 19. When the rear end of the paper P passes through the lever end 19, the pressing force to the lever end 19 disappears, and the lever end 19 restores to the protruding position at the upper portion again by the energization force of the spring 20 to the lever 17. The peeling claw 18 in a lifted state from the roller surface 27 is restored to the contacted state with the roller surface 27 again by interlocking with the restoring operation of the lever end 19. The toner adhered to the peeling claw 18 falls through the contact of the restored peeling claw 18 with the roller surface 27. The lever 17 is pressed by the paper P and the peeling claw 18 is lifted, and then the lever 17 returns to its original position when there is no paper P. The residual toner is peeled off from the roller surface 27 and falls by the impact at this time.

One paper P is exemplified as an example as stated above, and the image processing apparatus repeats the operation example of one paper P at conveyance intervals when copying and printing a plurality of paper P. The image processing apparatus repeats a series of operations including the paper feeding, image formation, secondary transfer, fixing, and paper discharging. In the series of operations, the peeling claw 18 peels off the paper P from the heat roller 10, and the residual toner adheres to the peeling claw 18 from the roller surface 27. The lever end 19 is pressed by the fixed paper P in the guide 15, the lever 17 swings in the anticlockwise direction w, and the peeling claw 18 is lifted from the roller surface 27. If the rear end of the paper P passes through the lever end 19, the lever 17 is returned to rotate in the clockwise direction z, and the lever end 19 restores to the protruding position at the upper portion. The peeling claw 18 starts to be in contact with the roller surface 27 by interlocking with the restoring operation of the lever end 19, and the toner adhered to the peeling claw 18 falls.

The image processing apparatus according to the present embodiment separates the front end of the peeling claw 18 from the heat roller 10 and then contacts the front end of the peeling claw 18 with the heat roller 10 by the swing of the lever 17 every time the paper P passes. By repeating such operations, it is possible to prevent the toner adhesion to the front end of the peeling claw 18 by the impact. Further, since the front end of the peeling claw 18 is not in contact with the heat roller 10 during the period the paper P is in contact with the lever 17, it is also possible to prevent the wear of the front end of the peeling claw 18 due to the rubbing of the heat roller 10. Consequently, the toner doesn't adhere to the front end of the peeling claw 18, and the paper P doesn't enter between the peeling claw 18 and the heat roller 10. The layer of the residual toner does not occur and the residual toner is not deposited on the roller surface 27, and thus no paper jam occurs. Thus, no toner is deposited on the peeling claw 18, no toner block is formed on the roller surface 27, and the residual toner does not bypass the left and right ends on the edge of the front end of the peeling claw. An image stain does not occur on the paper P due to the residual toner adhered to the peeling claw.

Further, during the switchback conveyance, the return mechanism 21 operates in such a manner that the lever end 19 lifts the paper P.

Figure 5:
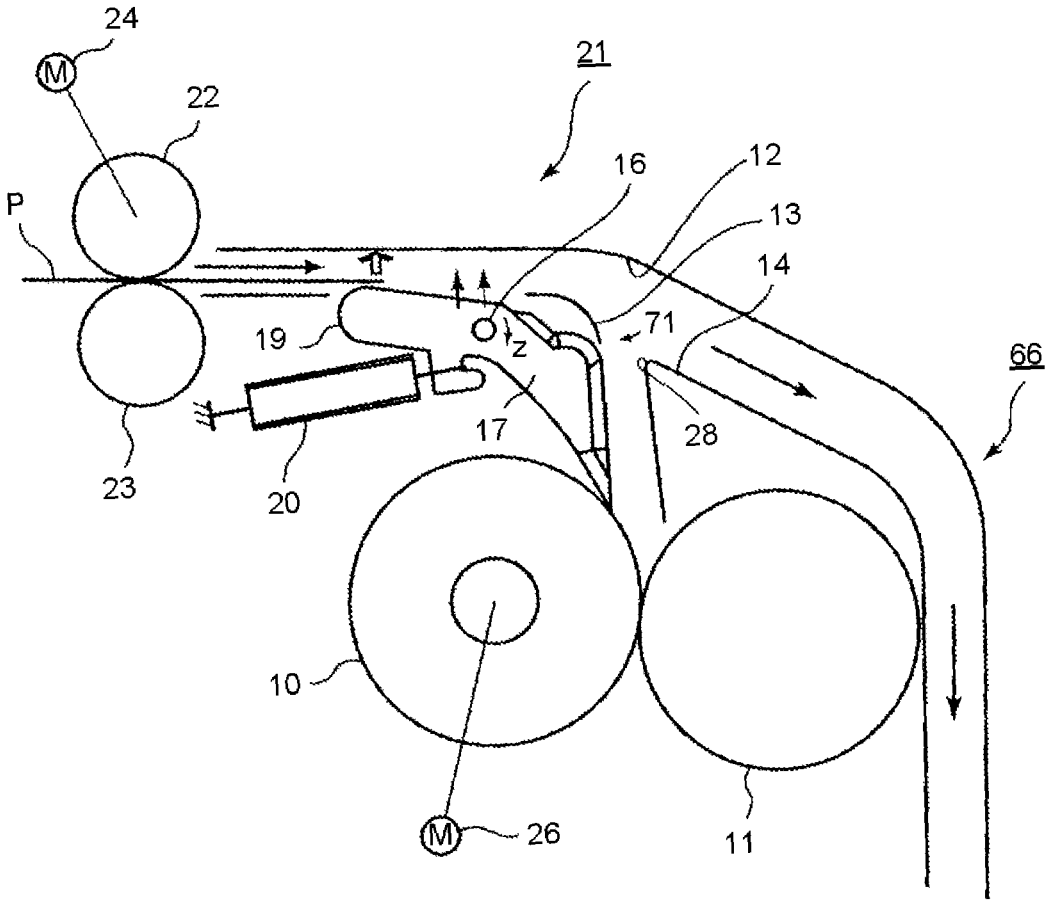
FIG. 5 is a diagram illustrating a state when performing switchback conveyance of a paper by the image processing apparatus according to the embodiment.

FIG. 5 is a diagram illustrating a state when performing switchback conveyance of a paper by the image processing apparatus according to the present embodiment. The reference numerals mentioned above represent the same components as defined in FIG. 1-FIG. 4. The reversal guide 66 is provided with the second lower guide wall 14 (guide bottom) for receiving the paper P switched back and conveyed by turning the paper P upside down through the backward rotation of the pair of the paper discharge rollers 22 and 23. An end portion 28 is formed by a bent part where the inclination of the lower guide wall 14 is curved at the inlet side of the reversal guide 66. Further, the spring 20 is an elastic member which is used to make the load capable of lifting the paper P having its own weight upward act on the lever 17 through the elastic restoring force thereof.

During the duplex printing, the controller 62 controls the pair of the paper discharge rollers 22 and 23 to rotate backward. The pair of the paper discharge rollers 22 and 23 replaces the front and rear ends in the conveyance direction of the paper P in a state of being partially drawn into the pair of the paper discharge rollers 22 and 23, the paper is turned upside down and the switchback conveyance is started. The paper P is switched back between the pair of the paper discharge rollers 22 and 23 and the lever 17, or between the pair of the paper discharge rollers 22 and 23 and the front end of the guide 15 (base end at the side of the bifurcating point 71). As to the return mechanism 21, if the rear end of the paper P passes through the lever end 19 during the forward conveyance prior to the switchback conveyance, the lever end 19 is in a state of being restored to the protruding position at the upper portion, and during the switchback conveyance, the rear end (the front end during the reverse conveyance) of the paper P jumps through the lifting force of the lever end 19 at the protruding position, and the rear end of the paper P is guided to the reversal guide 66 while it is in non-contact with the end portion 28 of the guide bottom 14. During the switchback conveyance, the lever 17 lifts the paper P with the lever end 19. In this way, in accordance with the image processing apparatus according to the present embodiment, even if the paper P droops downward more or less because of its own weight, the paper P is not in contact with the end portion 28 of the reversal guide 66, and therefore, no paper jam occurs.

During the duplex printing, the rear end (the front end during the reverse conveyance) of the paper P doesn't droop because of its own weight, and the paper P will not collide with the end portion 28 of the reversal guide. As a result, the rear end (the front end during the reverse conveyance) of the paper P does not enter the side of the heat roller 10 and the press roller 11. In accordance with the image processing apparatus according to the present embodiment, a paper jam can be prevented since the paper P is lifted by the lever end 19.

As stated above, in accordance with the image processing apparatus according to the present embodiment, no toner block is formed, no gap is generated between the front end of the peeling claw 18 and the roller surface 27, and thus no paper jam of the paper P occurs. The image processing apparatus with high reliability can continue to operate. Further, during the switchback conveyance in the duplex printing, even if the paper P is bent because of its own weight, the paper P is jacked up by the lever end 19 through the restoring operation of the lever 17 and the front end of the paper P jumps, and in this way, the front end of the paper will not contact or collide with the end portion 28, and a paper jam, a corner-fold and the like do not occur. Since no paper jam occurs, the printing job can be completed smoothly, thereby improving the printing speed of the whole image processing apparatus.

(A First Modification)

In the embodiment described above, the image may be rubbed due to the contact with the lever 17 since the lever 17 is in contact with the paper P directly, and a roller may be arranged at one end of the lever 17 so that the image is not rubbed by the lever 17. Unless otherwise specified, an image processing apparatus according to the first modification has the same constitution as that of the image processing apparatus according to the embodiment described above.

Figure 6:
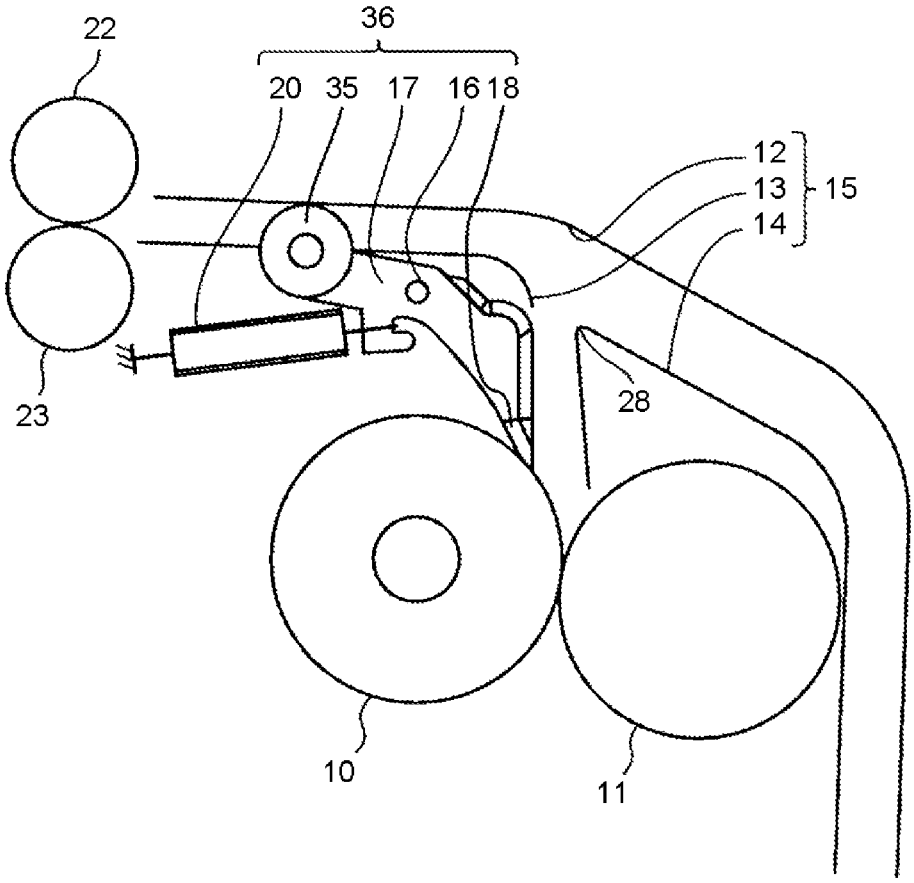
FIG. 6 is a diagram illustrating the constitution of a return mechanism of an image processing apparatus according to a first modification.

FIG. 6 is a diagram illustrating the constitution of a swing section of an image processing apparatus according to the first modification. The reference numerals mentioned above represent the same components as defined in FIG. 1-FIG. 5. A return mechanism 36 includes the lever 17 provided with the swing shaft 16 and the peeling claw 18, and a roller 35 pivotally supported by a lever end (not shown) at the left of the lever 17. The roller 35 abuts against the paper P with, for example, a roller surface made of synthetic rubber. The spring 20 has an elastic restoring force. The elastic restoring force has a magnitude capable of making the load for lifting the paper P upward act on the lever 17 according to a position of the lever 17 on which the weight of the lever 17, the weight of the roller 35 and the bearing portion thereof and the weight of the roller 35 are acted.

Next, the action of the image processing apparatus having such a constitution described above according to the modification is described. During the duplex printing, when an image failure is generated at a position where the paper P is rubbed by the lever 17, the roller 35 arranged at the front end of the lever 17 guides, through the rotation thereof from the lower portion to the upper portion, the paper surface of the paper P that is switched back and conveyed. Since the paper P is guided towards the upper guide wall 12 or jumps, the rubbing of the image can be eliminated. Further, during the switchback conveyance, the front end of paper will not contact or collide with the end portion 28, and therefore, a paper jam, a corner-fold and the like do not occur.

(A second Modification)

It is exemplified in the embodiment described above that the lever end 19 of the lever 17 is pressed by the paper P, and a pressing force may be applied through the paper P being conveyed by narrowing the conveyance space in the guide 15. Unless otherwise specified, an image processing apparatus according to the second modification has the same constitution as that of the image processing apparatus according to the embodiment described above.

Figure 7:
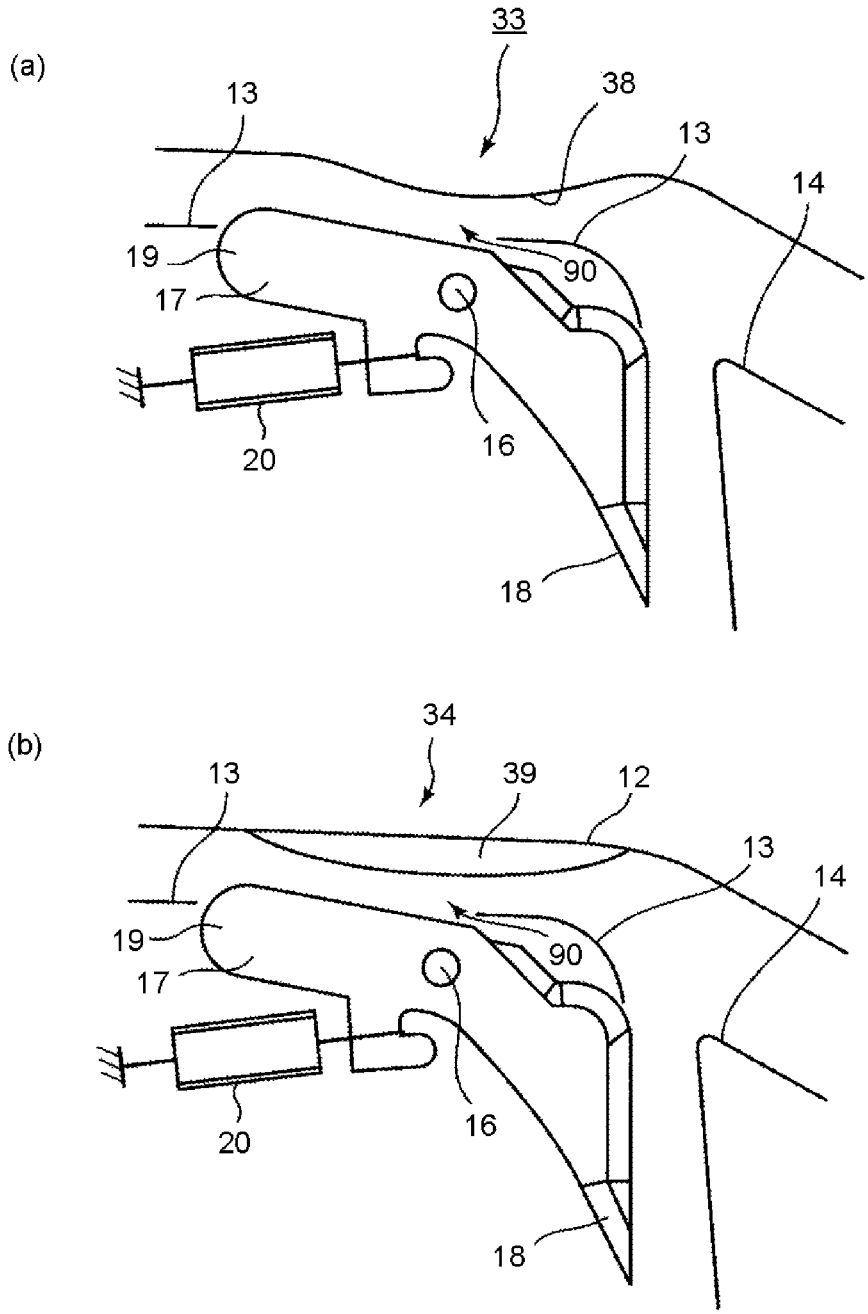
FIG. 7(*a*) and FIG. 7(*b*) are diagrams respectively illustrating the constitution of a first return mechanism of an image processing apparatus according to a second modification.

FIG. 7 (*a*) is a diagram illustrating the constitution of a first swing section of an image processing apparatus according to a second modification. The reference numerals mentioned above represent the same components as defined in FIG. 1-FIG. 6. The guide 15 or a return mechanism 33 is provided with a guide wall portion 38 on the upper guide wall 12 for narrowing the conveyance space from the upstream side to the downstream side in the conveyance direction. The return mechanism 33 repeats the following operations: separating the peeling claw 18 from the roller surface 27 (not shown in FIG. 7 (*a*)) by interlocking with the pressing of the lever end 19 downward due to the contact of the front end of the paper P guided by the guide wall portion 38 with the lever end 19, and restoring the peeling claw 18 in a separated state to the contacted state by interlocking with the restoration of the lever end 19 to the protruding position at the upper portion due to the passing of the rear end of the paper P through the lever end 19.

Next, the action of the image processing apparatus having such a constitution described above according to the modification is described. After the fixing processing, the front end of the paper P nipped and conveyed by the heat roller 10 and the press roller 11 is guided to the upper guide wall 12, and the paper P is further conveyed downward through the guide wall portion 38 by varying the advancing direction thereof. The lever 17 swings and the peeling claw 18 is lifted since the lever end 19 is pressed by the paper P, and then the peeling claw 18 returns to its original position when the rear end of the paper P passes. In this modification, the residual toner falls and the toner adhesion to the peeling claw 18 may be also prevented.

Further, FIG. 7(*b*) is a diagram illustrating the constitution of a second swing section of an image processing apparatus according to the second modification. The reference numerals mentioned above represent the same components as defined in FIG. 1-FIG. 6. The guide 15 or a return mechanism 34 may be provided with a guide wall portion 39 which serves as a component other than the wall and is fixed on the upper side wall 12. Since the return mechanism 34 narrows the conveyance space from the upstream side to the downstream side in the conveyance direction, the image processing apparatus operates similar to the example of FIG. 7(*a*).

(A Third Modification)

It is exemplified in the embodiment described above that the number of the lever 17 is one, and the swing section may also be constituted by a plurality of lever members. Unless otherwise specified, an image processing apparatus according to the third modification has the same constitution as that of the image processing apparatus according to the embodiment described above.

Figure 8:
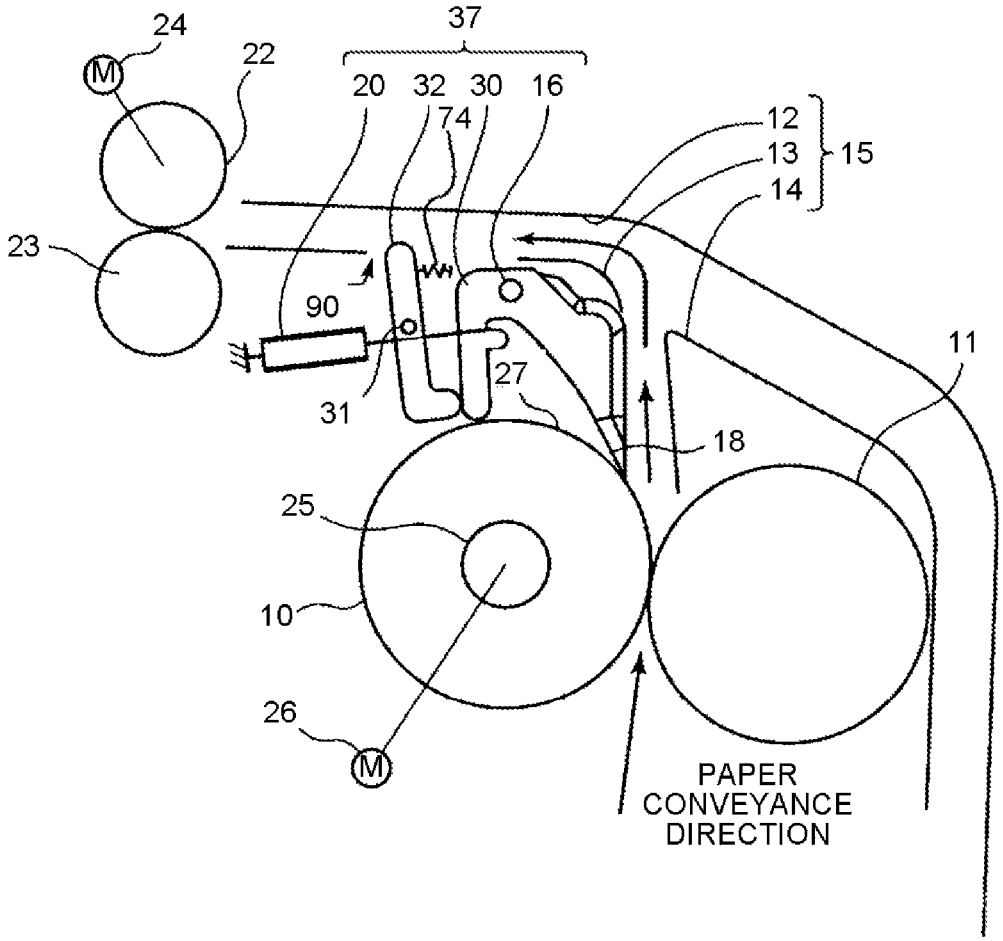
FIG. 8 is a diagram illustrating the constitution of a return mechanism of an image processing apparatus according to a third modification.

FIG. 8 is a diagram illustrating the constitution of a swing section of an image processing apparatus according to the third modification. The reference numerals mentioned above represent the same components as defined in FIG. 1-FIG. 7. A return mechanism 37 includes a lever 30 for abutting the peeling claw 18 against the roller surface 27 and energizing the peeling claw 18 to the roller surface 27 through the spring 20 and the swing shaft 16, an arm 32 for applying an energization force to the lever 30 in a rotation direction opposite to the rotation direction in which the lever 30 is energized to swing, and a swing shaft 31 for fixing and swinging the arm 32 with respect to the guide 15. One end of the arm 32 is energized by a spring 74 in one direction.

Next, in the image processing apparatus having such a constitution according to the present modification, generally, the peeling claw 18 is slidably in contact with the roller surface 27 of the heat roller 10. When the paper P is conveyed after being fixed, if the paper P is conveyed in the guide 15, the front end of the paper P presses the arm 32 to the left. The lower portion of the arm 32 swings in the anticlockwise direction by interlocking with the abutting action of the upper portion of the arm 32 to the left, and the lever 30 rotates in the anticlockwise direction w, thus, the peeling claw 18 is lifted. Further, when the rear end of the paper P passes through the arm 32, the arm 32 swings in the clockwise direction through the spring 74, the pressing force to the lever 30 from the arm 32 is released, and the lever 30 rotates in the clockwise direction z through the spring 20 and restores to its original position.

In accordance with the image processing apparatus according to the modification, the toner isn't adhered to the peeling claw 18, and therefore, a paper jam of the paper P does not occur, and during the switchback conveyance in the duplex printing, the front end of the paper P will not contact or collide with the end portion 28, and a paper jam, a corner-fold and the like do not occur.

(Other Modifications)

Various modifications for the shape, position, length and size of the lever 17, the peeling claw 18 and the lever end 19, and the position of the swing shaft 16 and the like are possible. It goes without saying that the shape exemplified in the embodiment described above is an example, and the present invention is not limited to the example shown in the figures. It is exemplified in the embodiment described above that the lever end 19 is a molded part formed continuously with the lever 17, and an end portion member separating from the lever 17 may be bonded with or connected to the end portion of the lever 17.

In the embodiment described above, the force for lifting the paper P upward from the lever end 19 through a swing energization force of the spring 20 is the load capable of lifting the paper P. In other words, the relation between the peeling claw 18 and the lever 17 is a lever-action relation in which the point where the paper P contacts with the lever end 19 and presses the lever end 19 is a point of force, the swing shaft 16 is a rotation fulcrum, and the peeling claw 18 is taken as a point of action. According to the lever principle, the force required for lifting the peeling claw 18 serving as the point of action can be calculated only by obtaining the distance between the fulcrum and the point of force, and various modifications for the magnitude of the load capable of lifting the paper P and the structure of the lever 17 are possible when the lever 17 is formed in a shape in which the distance from the swing shaft 16 to the lever end 19 is longer than that exemplified in the figures.

It is exemplified that the size in the apparatus depth direction of the peeling claw 18 is thinner than the width of the image area of the heat roller 10, and a plurality of peeling claws 18 may be arranged in the roller shaft direction. Various modifications for the width of claw in the apparatus depth direction are possible. A transparent sheet and the like may be used as the medium. An elastic rubber body and an actuator other than the spring 20 may be used as the energization member of the lever 17. Various variations are possible, and the image processing apparatus according to the embodiments subjected to such variations is not degraded in superiority.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image processing apparatus, comprising:

a heat roller configured to have a roller surface for contacting a medium on which an unfixed toner image is transferred;

a press roller configured opposite to the heat roller;

a guide configured along a conveyance space from an inlet arranged at a downstream side in a conveyance direction of the medium, which is conveyed and nipped by the heat roller and the press roller, to an outlet of the medium;

a lever configured to be provided with a swing shaft with respect to the guide, a peeling claw arranged at the inlet side for scraping the toner off the roller surface, and a lever end positioned at the outlet side;

a swing section configured to swing and energize the lever to make the lever end protrude into the conveyance space, wherein the lever that is swung and energized by the swing section repeats the following operations: separating the peeling claw in a contacted state with the roller surface from the roller surface, and restoring the peeling claw to the contacted state;

a pair of paper discharge rollers configured at the outlet side of the guide to rotate forward or rotate backward; and a reversal guide configured to be provided with a guide bottom for receiving the medium switched back and conveyed by turning the medium upside down through the backward rotation of the pair of paper discharge rollers, wherein if the rear end of the medium passes through the lever end during the forward conveyance prior to the switchback conveyance, the lever end restores to the protruding position at the upper portion, and during the switchback conveyance, the rear end of the medium jumps through a lifting force of the lever end at the protruding position, and the rear end is guided to the reversal guide while it is in non-contact with the end portion of the guide bottom.

2. The image processing apparatus according to claim 1, further comprising:

a pair of paper discharge rollers arranged at the outlet side of the guide, wherein the lever presses the front end of the peeling claw against the roller surface through the energization of the swing section, and the peeling claw repeats the following operations: separating from the roller surface by interlocking with the pressing of the lever end downward due to the contact of the medium in a state of being applied with a tension by the pair of the paper discharge rollers with the lever end, and restoring to the contacted state from the separated state by interlocking with the restoration of the lever end to the protruding position at the upper portion due to the passing of the rear end of the medium through the lever end.

3. The image processing apparatus according to claim 1, wherein the lifting force for lifting the medium towards upward from the lever end by the swing energization force of the swing section applied to the lever is a load capable of lifting the medium against the weight of the medium.

4. The image processing apparatus according to claim 1, wherein in the guide is formed a guide wall portion for narrowing the conveyance space from the upstream side to the downstream side in the conveyance direction, the lever presses the front end of the peeling claw against the roller surface by the energization of the swing section, and the peeling claw repeats the following operations: separating from the roller surface by interlocking with the pressing of the lever end downward due to the contact of the front end of the medium guided by the guide wall portion with the lever end, and restoring to the contacted state from the separated state by interlocking with the restoration of the lever end to the protruding position at the upper portion due to the passing of the rear end of the medium through the lever end.

* * * * *